United States Patent [19]

Skinner et al.

[11] Patent Number: 4,715,893

[45] Date of Patent: Dec. 29, 1987

[54] ALUMINUM-IRON-VANADIUM ALLOYS HAVING HIGH STRENGTH AT ELEVATED TEMPERATURES

[75] Inventors: David J. Skinner, Flanders; Richard L. Bye, Jr., Morristown; Kenji Okazaki, Basking Ridge; Colin M. Adam, Morristown, all of N.J.

[73] Assignee: Allied Corporation, Morris Township, Morris County, N.J.

[21] Appl. No.: 596,741

[22] Filed: Apr. 4, 1984

[51] Int. Cl.[4] ..... C22C 21/00; C22C 21/10; C22C 21/12; B22F 9/06

[52] U.S. Cl. ..... 75/249; 420/540; 420/550; 420/551; 148/403; 75/0.5 R

[58] Field of Search ..... 420/540, 550, 551; 419/48, 60; 75/249, 0.5 R; 148/403

[56] References Cited

U.S. PATENT DOCUMENTS

| | | | |
|---|---|---|---|
| 2,963,780 | 12/1960 | Lyle, Jr. et al. | 29/182 |
| 2,966,731 | 1/1961 | Towner et al. | 29/182 |
| 2,966,732 | 1/1961 | Towner et al. | 29/182 |
| 2,966,733 | 1/1961 | Towner et al. | 29/182 |
| 2,966,734 | 1/1961 | Towner et al. | 29/182 |
| 2,966,735 | 1/1961 | Towner et al. | 29/182 |
| 2,966,736 | 1/1961 | Towner et al. | 29/182 |
| 2,967,351 | 1/1961 | Roberts et al. | 29/420.5 |
| 2,994,947 | 8/1961 | Towner et al. | 29/182 |
| 3,004,331 | 10/1961 | Towner et al. | 29/182 |
| 3,462,248 | 8/1969 | Roberts et al. | 29/182 |
| 3,625,677 | 12/1968 | Jones | 75/138 |
| 3,899,820 | 8/1975 | Read et al. | 29/420.5 |
| 4,347,076 | 8/1982 | Ray et al. | 75/0.5 R |
| 4,379,719 | 4/1983 | Hildeman et al. | 419/60 |

FOREIGN PATENT DOCUMENTS

| | | |
|---|---|---|
| 1349452 | 9/1970 | United Kingdom . |
| 1362209 | 10/1971 | United Kingdom . |
| 2088409 | 11/1981 | United Kingdom . |

OTHER PUBLICATIONS

Shechtman et al, "Metallurgical Transactions A", vol. 16A, Jun. 1985, pp. 1005–1012.

Rao et al, "Europhysics Letters", 1 (12), 1986, pp. 647–653.

Dunlap et al, "Can. J. Physics", 63, 1267 (1985), pp. 1267–1269.

Khanna et al, "Scripta Metallurgica", vol. 20, 1986, pp. 395–396.

Long et al, "Acta Cryst." (1986), A42, pp. 156–164.

Cahn et al, "J. Mater. Res.", vol. 1, No. 1, Jan./Feb. 1986, pp. 13–26.

Shechtman et al, "Physical Review Letters", vol. 53, No. 20, 1984, pp. 1951–1953.

Steinhardt et al, "Physical Review B", vol. 28, No. 2, 1983, pp. 784–805.

Nelson, "Physical Review B", vol. 28, No. 10, 1983, pp. 5515–5535.

(List continued on next page.)

*Primary Examiner*—Richard D. Lovering

*Assistant Examiner*—Eric Jorgensen

*Attorney, Agent, or Firm*—Ernest D. Buff; Gerhard H. Fuchs

[57] ABSTRACT

The invention provides an aluminum based alloy consisting essentially of the formula $Al_{bal}Fe_aV_bX_c$, wherein X is at least one element selected from the group consisting of Zn, Co, Ni, Cr, Mo, Zr, Ti, Hf, Y and Ce, "a" ranges from about 7–15 wt %, "b" ranges from about 2–10 wt %, "c" ranges from about 0–5 wt % and the balance is aluminum. The alloy has a distinctive microstructure which is at least about 50% composed of a generally spherical, intermetallic O-phase.

Particles composed of the alloys of the invention can be heated in a vacuum and compacted to form a consolidated metal article have high strength and good ductility at both room temperature and at elevated temperatures of about 350° C. The consolidated article is composed of an aluminum solid solution phase containing a substantially uniform distribution of dispersed intermetallic phase precipitates therein. These precipitates are fine intermetallics measuring from about 10 nm to about 100 nm in diameter with an average interparticle spacing ranging from 50–500 nm.

11 Claims, 13 Drawing Figures

OTHER PUBLICATIONS

Mackay, "Physica", 114A (1982), pp. 609–613.
Mackay, "Acta. Cryst.", (1962), 15, pp. 916–918.
Skinner et al, "ASTM STP 890", 1986, pp. 211–236.
Bancel et al, "Physical Review Letters", vol. 54, No. 22, 1985, pp. 2422–2425.
Adam et al, "Undercooled Phases in Aluminum–Iron Alloys", no date.
Hiraga et al, "Journal of the Physical Society of Japan"; vol. 54, No. 11, 1985, pp. 4077–4080.
Kuriyama et al, "Acta Crystal" (1986), A42, pp. 164–172.
Business Communication by Marko Materials, Inc., 8/12/81.
P. P. Millam, Jr., "Applications of High-Temperature Powder Aluminum Alloys to Small Gas Turbines", Mar. 1983, pp. 76–81.
C. M. Adam, "Structure/Property Relationships and Applications of Rapidly Solidified Aluminum Alloys", copyright 1982, pp. 411–422.
H. Jones, "Observations on a Structural Transition in Aluminum Alloys Hardened by Rapid Solidification", Mar. 1969, pp. 1–18.
M. H. Jacobs et al., "A Study of Microstructure and Phase Transformations in an Annealed, Rapidly Quenched, Al–8 wt% Fe Alloy", 1970, pp. 18.1–18.16.
G. Thursfield et al., "Elevated Temperature Mechanical Properties of a Rapidly Quenched Al–8 wt% Fe Alloy", 1970, pp. 19.1–19.6.

20 μm

1 HR. AT 300°c

20 μm

1 HR. AT 350°c

20 μm

1 HR. AT 400°c

20 μm

1 HR. AT 450°c

Al - 12Fe - 2V

ALUMINUM-IRON-VANADIUM ALLOYS HAVING HIGH STRENGTH AT ELEVATED TEMPERATURES

DESCRIPTION

1. Field of the Invention

The invention relates to aluminum alloys having high strength at elevated temperatures, and relates to powder products produced from such alloys. More particularly, the invention relates to aluminum alloys having sufficient engineering tensile ductility for use in high temperatures structural applications which require ductility, toughness and tensile strength.

2. Brief Description of the Prior Art

Methods for obtaining improved tensile strength at 350° C. in aluminum based alloys have been described in U.S. Pat. No. 2,963,780 to Lyle, et al.; U.S. Pat. No. 2,967,351 to Roberts, et al.; and U.S. Pat. No. 3,462,248 to Roberts, et al. The alloys taught by Lyle, et al. and by Roberts, et al. were produced by atomizing liquid metals into finely divided droplets by high velocity gas streams. The droplets were cooled by convective cooling at a rate of approximately $10^4$° C./sec. As a result of this rapid cooling, Lyle, et al. and Roberts, et al. were able to produce alloys containing substantially higher quantities of transition elements than had theretofore been possible.

Higher cooling rates using conductive cooling, such as splat quenching and melt spinning, have been employed to produce cooling rates of about $10^6$° to $10^7$° C./sec. Such cooling rates minimize the formation of intermetallic precipitates during the solidification of the molten aluminum alloy. Such intermetallic precipitates are responsible for premature tensile instability. U.S. Pat. No. 4,379,719 to Hildeman, et al. discusses rapidly quenched, aluminum alloy powder containing 4 to 12 wt % iron and 1 to 7 wt % Ce or other rare earth metal from the Lanthanum series.

U.S. Pat. No. 4,347,076 to Ray, et al. discusses high strength aluminum alloys for use at temperatures of about 350° C. that have been produced by rapid solidification techniques. These alloys, however, have low engineering ductility at room temperature which precludes their employment in structural applications where a minimum tensile elongation of about 3% is required. An example of such an application would be in small gas turbine engines discussed by P. T. Millan, Jr.; *Journal of Metals,* Volume 35 (3), 1983, page 76.

Ray, et al. discusses aluminum alloys composed of a metastable, face-centered cubic, solid solution of transition metal elements with aluminum. The as-cast ribbons were brittle on bending and were easily comminuted into powder. The powder was compacted into consolidated articles having tensile strengths of up to 76 ksi at room temperature. The tensile ductility of the alloys was not discussed in detail in Ray, et al. However, it is known that many of the alloys taught by Ray, et al., when fabricated into engineering test bars, do not possess sufficient room temperature ductility for use in structural components.

Thus, conventional aluminum alloys, such as those taught by Ray, et al., have lacked sufficient engineering ductility. As a result, these conventional alloys have not been suitable for use in structural components.

SUMMARY OF THE INVENTION

The invention provides an aluminum based alloy consisting essentially of the formula $Al_{bal}Fe_aV_bX_c$, wherein X is at least one element selected from the group consisting of Zn, Co, Ni, Cr, Mo, Hf, Zr, Ti, Y and Ce, "a" ranges from about 7–15 wt %, "b" ranges from about 2–10 wt %, "c" ranges from about 0–5 wt % and the balance is aluminum. The alloy has a microstructure at least about 50% of which is composed of a generally spherical, intermetallic O-phase.

Since the cast alloy contains the distinctive O-phase microstructure, it can be processed into particles which, in turn, can be compacted into consolidated articles having an advantageous combination of high strength and ductility at room temperature and at elevated temperatures. Such consolidated articles can be effectively employed as structural members.

Consolidated articles are produced by compacting particles composed of an aluminum based alloy consisting essentially of the formula $Al_{bal}Fe_aV_bX_c$. Wherein X is at least one element selected from the group consisting of Zn, Co, Ni, Cr, Mo, Zr, Ti, Hf, Y and Ce. "a" ranges from about 7–15 wt %, "b" ranges from about 2–10 wt % "c" ranges from about 0–5 wt % and the balance of the alloy is aluminum. Additionally, the alloy particles have a microstructure which is at least about 50% composed of a generally spherical, intermetallic O-phase. The particles are heated in a vacuum during the compacting step to a pressing temperature ranging from about 300° to 500° C., which minimizes coarsening of the dispersed, intermetallic phases.

The consolidated article of the invention is composed of an aluminum solid solution phase containing a substantially uniform distribution of dispersed, intermetallic phase precipitates therein. These precipitates are fine, intermetallics measuring less than about 100 nm in all linear dimensions thereof. The consolidated article has a combination of an ultimate tensile strength of approximately 275 MPa (40 ksi) and sufficient ductility to provide an ultimate tensile strain of at least about 10% elongation when measured at a temperature of approximately 350° C.

Thus, the invention provides alloys and consolidated articles which have a combination of high strength and good ductility at both room temperature and at elevated temperatures of about 350° C. As a result, the consolidated articles of the invention are stronger and tougher than conventional high temperature aluminum alloys, such as those taught by Ray, et al. The articles are more suitable for high temperature applications, such as structural members for gas turbine engines, missiles and air frames.

BRIEF DESCRIPTION OF THE DRAWINGS

The invention will be more fully understood and further advantages will become apparent when reference is made to the following detailed description of the preferred embodiment of the invention and the accompanying drawings in which:

FIG. 6(*b*) shows a diffraction pattern of an alloy of the invention having an O-phase microstructure;

DETAILED DESCRIPTION OF THE INVENTION AND THE PREFERRED EMBODIMENTS

Figure 1:
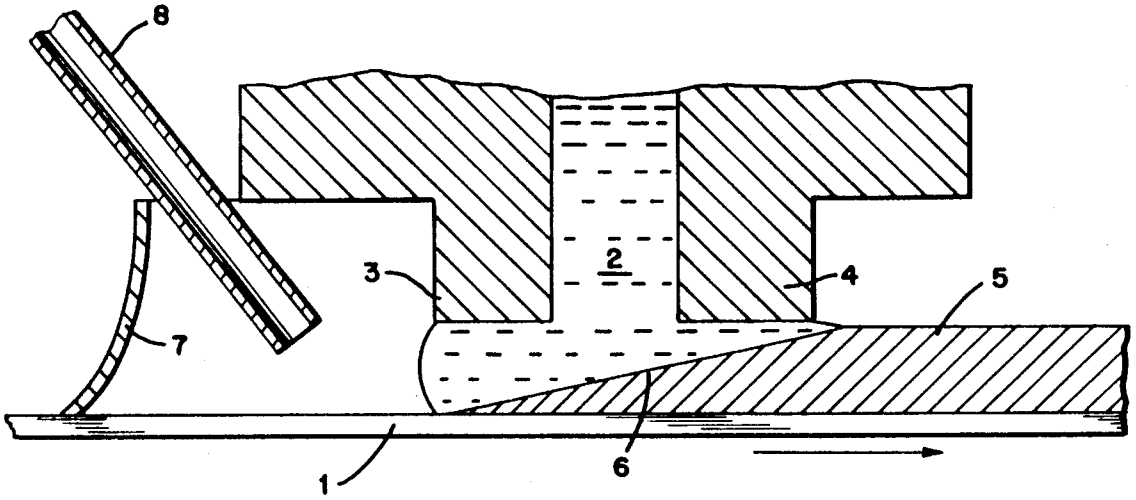
FIG. 1 shows a schematic representation of a casting apparatus employed to cast alloys of the invention.

FIG. 1 shows a partial cross-sectional side view illustrating the method by which the alloys the present invention are cast. As shown in FIG. 1, molten metal 2 of the desired composition is forced under pressure through a slotted nozzle defined by a first lip 3 and a second lip 4 onto the surface of a chill body 1 which is held in close proximity to the nozzle and moves in the direction indicated by the arrow. A scraping means including scraper 7 is located in contact with the chill substrate, and an inert or reducing gas is introduced by a gas supply means through a gas inlet tube 8.

Since casting surface 1 moves very rapidly at a speed of at least about 1200 to 2750 meters per minute, the casting surface carries along an adhering gas boundary layer and produces a velocity gradient within the atmosphere in the vicinity of the casting surface. Near the casting surface the boundary layer gas moves at approximately the same speed as the casting surface; at positions further from the casting surface, the gas velocity gradually decreases. This moving boundary layer can strike and destabilize the stream of molten metal coming from crucible 2. In severe cases, the boundary layer blows the molten metal stream apart and prevents the desired quenching of the molten metal. In addition, the boundary layer gas can become interposed between the casting surface and the molten metal to provide an insulating layer that prevents an adequate quenching rate. To disrupt the boundary layer, the apparatus of the invention employs conditioning means located upstream from crucible 2 in the direction counter to the direction of casting surface movement. In a preferred casting apparatus, the conditioning means is comprised of the scraper means and the supply of inert or reducing gas.

Figure 3:
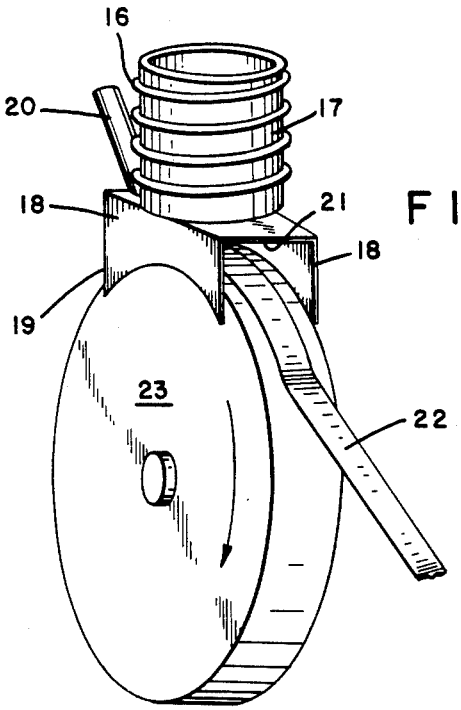
FIG. 3 shows a perspective view of the opposite side of the apparatus shown in FIG. 2.
Figure 2:
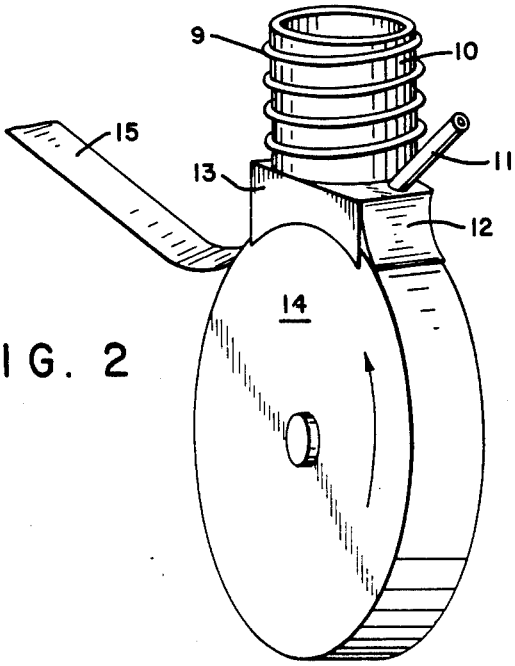
FIG. 2 shows a perspective view of the apparatus employed to produce the alloys of the invention.

FIGS. 2 and 3 are simplified perspective views from two different angles showing, with reference to FIG. 3, how side shields 18 are used in conjunction with the substrate scraper 19 and the gas inlet tube 20 to provide a semi-enclosed chamber around the nozzle 21.

It has been found that the preferred protective gas is carbon monoxide, although other gases such as helium, nitrogen or argon can be used. The advantage of using CO is that it burns, combining with oxygen present around the nozzle to produce hot $CO_2$. The process reduces the oxygen available for alloy oxidation, keeps the nozzle hot and produces a gas of lower density than air to impinge on the melt puddle.

The presence of the scraper and side shields markedly improves the effectiveness of the CO flame. Without the scraper, the CO tends to burn downstream of the nozzle only, with the result that if ribbon is formed at all it is thin and full of holes, indicating poor melt/substrate contact. With a scraper the flame burns upstream of the nozzle and of the gas inlet tube, indicating the effectiveness of the scraper in removing the air boundary layer and, therefore, creating a low pressure area behind it which is filled by the protective gas. Without side shields, however, extraneous wind currents generated by the moving substrate assembly can distort the gas flow so that it does not uniformly impinge upon the nozzle and melt puddle. Under these conditions, the ribbon can be formed non-uniformly. In particular, one or both ribbon edges tend to be irregular. However, when side shields are used in conjunction with the scraper blade and protective gas, the gas flow pattern is uniform and consistent, and ribbon can be cast reliably.

The precise dimensions and location of the scraping means, gas supply and shielding means are not critical, but several general concepts should be adhered to. The scraping means, gas supply and shielding portions of the casting apparatus, that is, the side shields, scraper blade, and gas inlet tube should be located to ensure that a uniform gas flow pattern is maintained. In general, the opening of the gas inlet tube should be located within 2 to 4 inches of the nozzle. The scraper should be positioned as close as is practical to the gas inlet tube to ensure that the protective gas flows into the low pressure area behind it and not the ambient atmosphere, and the side shields should be located so that they extend from the scraper to a point roughly 2 to 3 inches past the nozzle slot. The shield should be of a height such that they are close to or in contact with the substrate assembly at the bottom and the underside of the nozzle or nozzle support at the top. The nozzle or nozzle support should be such that when it is in the casting position, the scraper, the side shields and the underside of the nozzle support form a semi-enclosed chamber around the nozzle slot which maximizes the effect of the inert or protective gas, as shown in Figs.

The alloys of the invention are rapidly solidified ribbons which cool at a rate in excess of $10^{6}$° C./sec; preferably the cooling rate is at least about $10^{7}$° C./sec.

Casting surface 1 is typically a peripheral surface of a rotatable chill roll or the surface of an endless chilled belt constructed of high thermal conductivity metal, such as steel or copper alloy. Preferably, the casting surface is composed of a Cu-Zr alloy.

Figure 5:
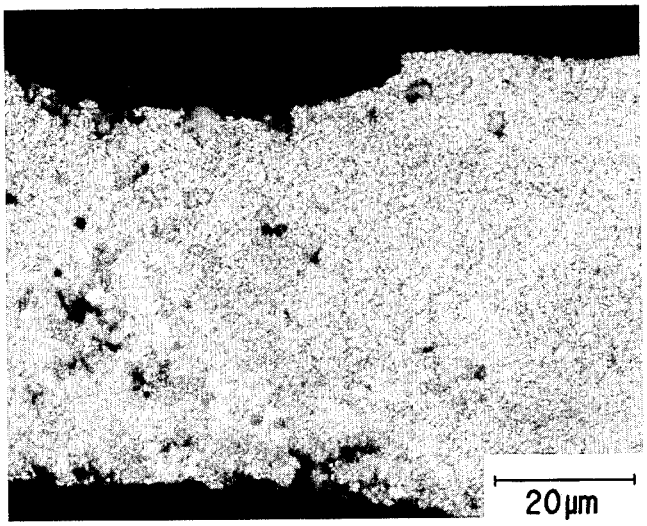
FIG. 5 shows a photomicrograph of a dendritic alloy which has not been adequately quenched at a uniform rate.

To rapidly solidify molten metal alloy and produce a desired microstructure, the chill roll or chill belt should be constructed to move casting surface 1 at a speed of at least about 4000 ft/min (1200 m/min), and preferably at a speed ranging from about 6500 ft/min (2000 m/min) to about 9,000 ft/min (2750 m/min). This high speed is required to provide uniform quenching throughout the cast strip of metal, which is less than about 40 micrometers thick. Uniform quenching at a cooling rate of at least about $10^{7}$° C./sec is important to provide the O-phase microstructure within the solidified metal alloy. If the speed of the casting surface and quench rate are too low the solidified alloy can have a heavily dendritic morphology exhibiting large, coarse precipitates, or a microeutectic morphology, as representatively shown in FIG. 5.

The apparatus described above is particularly useful for producing high strength, aluminum-based alloys consisting essentially of the formula $Al_{bal}Fe_aV_bX_c$, wherein "a" ranges from about 7–15 wt %, "b" ranges from about 2–10 wt %, "c" ranges from about 0–5 wt % and the balance is aluminum plus incidental impurities. X is one or more of the elements selected from the group consisting of Zn, Co, Cr, Mo, Zr, Ti, Y, Hf and Ce. The alloys have advantageous combination of ductility, high strength and high hardness; for example the micro Vickers hardness of the as-cast alloy is at least about 350 kg/mm$^2$ (3500 MPa).

To provide an especially desired combination of high strength and ductility at temperatures up to about 350° C., the alloy consists essentially of the formula $Al_{bal}$-$Fe_aV_b$, wherein "a" ranges from about 12–15 wt %, "b" ranges from about 2–4 wt % and up to about 2 wt % of the aluminum is optionally replaced by one or more of the elements from the X group.

Figure 4:
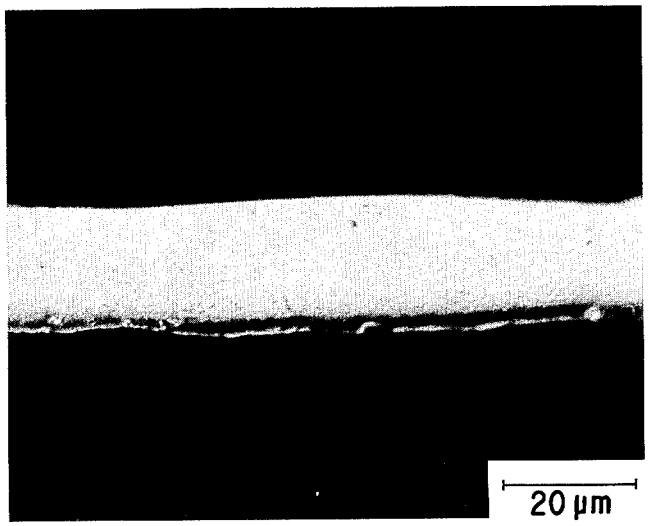
FIG. 4 shows a photomicrograph of an alloy of the invention.

In alloys of the invention, optical microscopy reveals a uniform featureless morphology when as-cast strip is etched by conventional Kellers etchant. See, for example, FIG. 4. When the as-cast strip of FIG. 4 is viewed by transmission electron microscopy, as representatively shown in FIG. 6, the alloys of the invention contain a distinctive, approximately spherical phase measuring about 10 nm to 500 nm in diameter which is distributed throughout the as-cast ribbon. This phase is capable of generating alloys of very high hardness and strength that are useful for constructing structural members employing conventional powder metallurgy techniques. More specifically the alloys of the invention can be precipitation hardened from an as-cast hardness of 3500 MPa to a hardness of 6000–7000 MPa by appropriate annealing.

This new, approximately spherical structure, designated O-phase for the purposes of the invention, is a single metastable intermetallic phase consisting essentially of iron, vanadium and aluminum atoms incorporated into a complex crystalline unit cell. To provide an especially advantageous combination of strength and ductility, the O-phase should measure at least about 50 nm in diameter. These larger diameter O-phase regions can better withstand higher processing temperatures and can withstand longer time periods at conventional processing temperatures. Alloys containing the larger O-phase regions can produce and retain finer precipitates when the alloys are heat treated. These fine precipitates provide increased strength and ductility in the heat treated alloy.

Quantitative electron microscopy has shown that a representative composition of the O-phase is approximately Al-15 wt % Fe-4 wt %V; an approximate chemical formula would be $Al_{89.5}Fe_8V_{2.4}$, which is close to $Al_9$ (Fe,V).

Figure 6A:
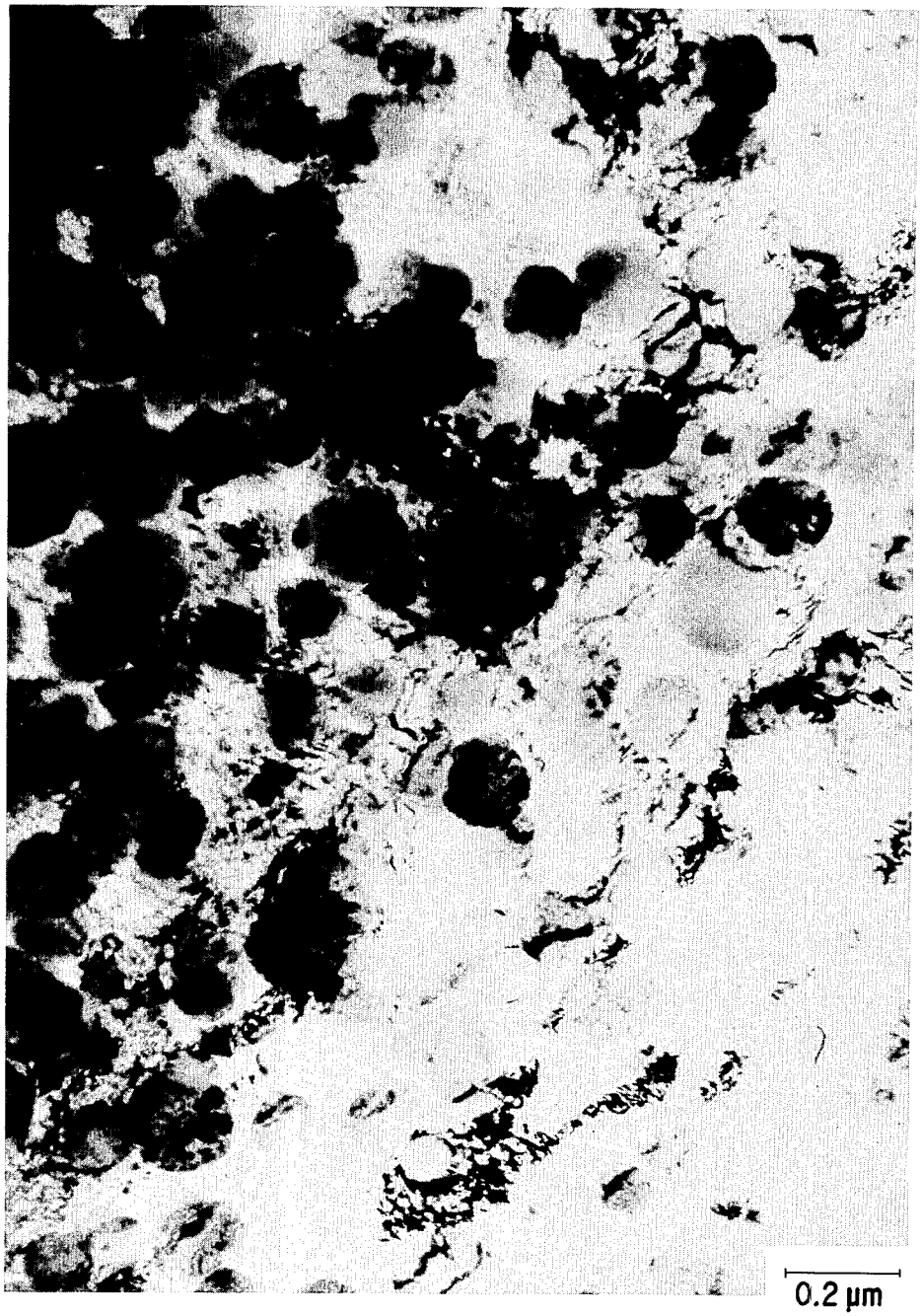
FIG. 6(*a*) shows a transmission electron micrograph of an as-cast aluminum alloy of the invention having an O-phase microstructure.
Figure 6B:
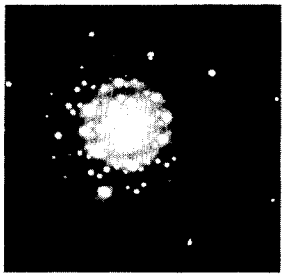
Figure 7A:
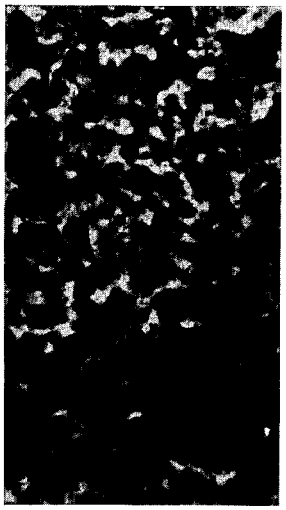
FIGS. 7 (*a*), (*b*), (*c*) and (*d*) show transmission electron micrographs of aluminum alloy microstructures after annealing.
Figure 7B:
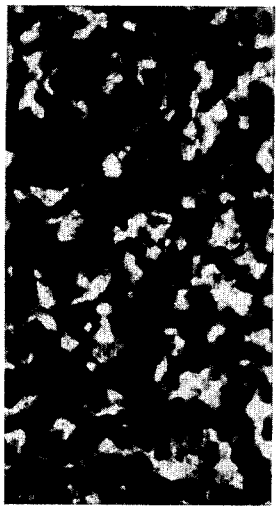
Figure 7C:
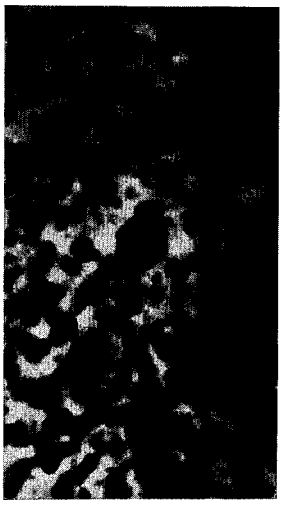
Figure 7D:
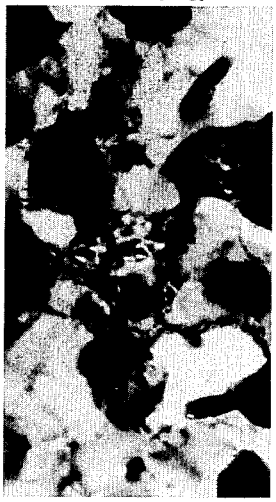
Figure 8:
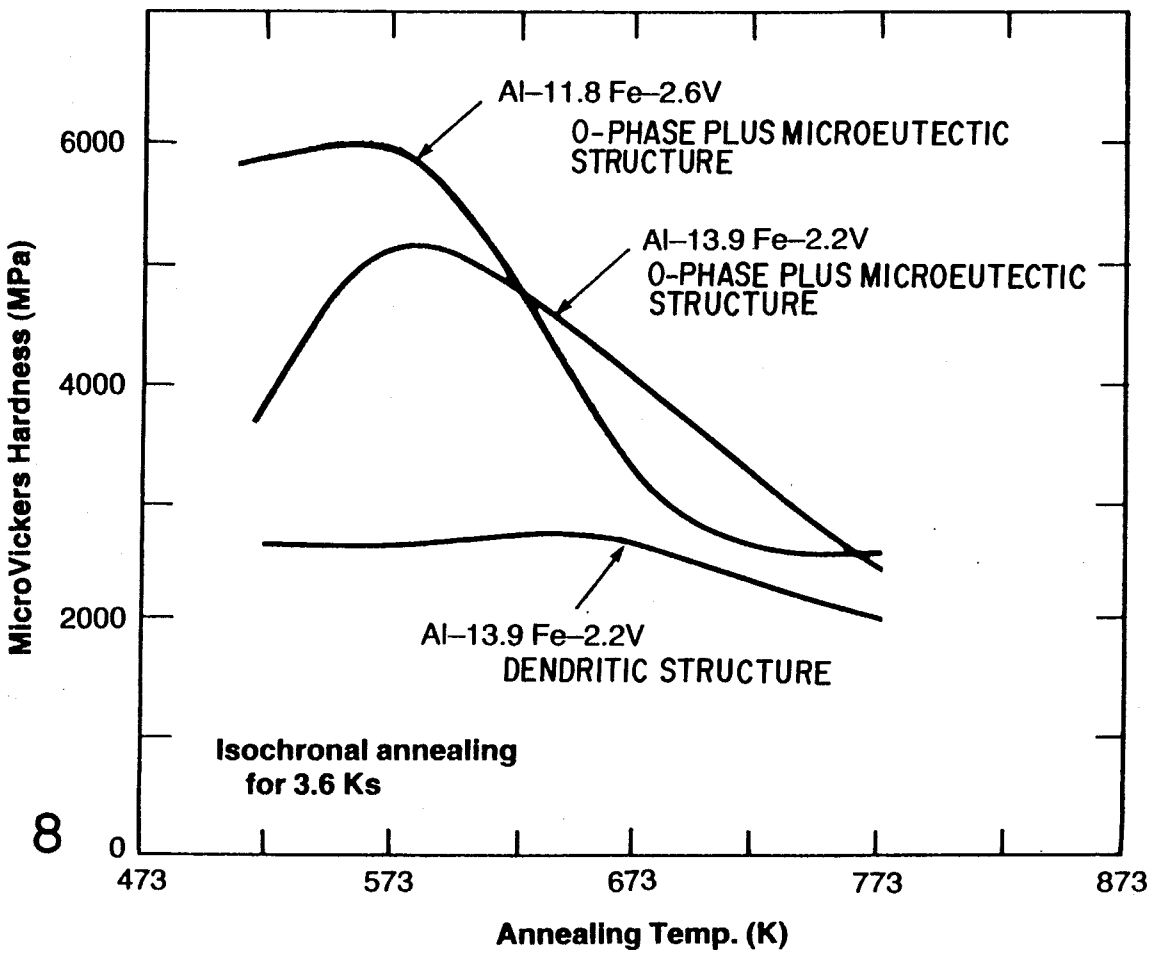
FIG. 8 shows plots of hardness versus isochronal annealing temperature for alloys of the invention.

Preliminary electron diffraction has shown this phase to have a complicated diffraction pattern (FIG. 6 (*b*)) which can be indexed on the basis of a body-centered tetragonal cell where in a first approximation a=b=2.5 nm and c=3.5 nm. X-ray diffractometry of the O-phase has shown the predominant interplanar spacings listed in Table A, which can be compared with measured interplanar spacings obtained from electron diffraction patterns. Systematic absences in the electron diffraction pattern indicate that the structure is a layered, twinned or partially ordered, crystal structure, having the appearance in transmission electron micrographs of a fine, two-phase structure. More sophisticated crystallographic investigation are needed to accurately determine the space group, detailed atomic positions and lattice parameters of the basic unit cell.

TABLE A d Values ($10^{-8}$ cm)

1. 4.63
2. 2.59
3. 2.45
4. 2.17
5. 2.16
6. 2.07
7. 2.06
8. 1.28

The range of alloy chemistry, within the O-phase structure, may vary. For example, with rapid solidification at quench rates greater than about $10^6$ K/sec, the formula of the O-phase may vary from $Al_6$(Fe, V, X) in alloys like Al-15Fe-5V-5X to $Al_{12}$(Fe, V, X) in alloys like Al-12Fe-2V-1X. Depending on the specific rate of solidification and the concentration of element X in the alloy composition, the O-phase may occupy from 50% to 100% of the as-solidified microstructure, with the remainder of the alloy composed of a microeutectic microstructure.

The microeutectic microstructure is a substantially two-phase structure having no primary phases, but composed of a substantially uniform, cellular network of a solid solution phase containing aluminum and transition metal elements, the cellular regions ranging from about 30 to 100 nanometers in size. The other phase, which is intercellular or fibrous in spatial distribution, is comprised of extremely stable precipitates of very fine, binary or ternary, intermetallic phases which are less than about 5 nanometers in width and composed of aluminum and transition metal elements (AlFe, AlFeX). The ultrafine, dispersed fibrous or intercellular phase includes, for example, metastable variants of AlFe with vanadium and zirconium in solid solution. At sufficiently rapid solidification rates of $10^7$ K/sec, for example, this intermetallic phase shows evidence of being amorphous when examined by transmission electron diffraction. The intermetallic phases are substantially uniformly dispersed within the microeutectic structure and intimately mixed with the aluminum solid solution phase, having resulted from a eutectic-like solidification.

In alloys composed of Al-(14 to 15) wt % Fe - 3 wt % V, the spherical O-phase comprises about 50% of the microstructure. In alloys containing greater amounts of vanadium and transition metal elements from the X group, the O-phase can be more than 50% of the microstructure.

During annealing of as-cast ribbon, the O-phase decomposes on heating to produce very fine ternary or quaternary intermetallic strengthening precipitates. These precipitate particles have interparticle spacings which range from about 10 nm to about 200 nm, and have sizes which range from about 1 nm to about 10 nm, as representatively shown in FIG. 7. The annealed alloy can have a hardness value of about 6000 MPa and a tensile strength of about 700 MPa. In Al-Fe-V alloys, the fine intermetallics precipitate from the O-phase as circular discs with a coherent crystallographic relationship to the aluminum matrix phase.

This O-phase microstructure is retained by the alloys of the invention after annealing for one hour at temperatures up to about 350° C. (660° F.) without significant structural coarsening, as representatively shown in FIG. 7(*a*), (*b*). At temperatures greater than about 400°

C. (750° F.), the O-phase microstructure decomposes to the aluminum alloy matrix plus fine intermetallics, as representatively shown in FIG. 7(*c*), the exact temperature of the decomposition depending upon the alloy composition and the time of exposure. At longer times and/or higher temperatures, these intermetallics coarsen into spherical or polygonal shaped dispersoids, as representatively shown in FIG. 7(*d*).

The O-phase microstructure is important because it provides highly homogeneous regions of the constituent elements. These homogeneous O-phase regions, in turn, are particularly able to develop a substantially homogeneous dispersion of very small intermetallic phase regions within the aluminum solid solution phase. With appropriate heat treatment, these intermetallic precipitate particles can be provided with an optimized combination of size; e.g. diameter; and interparticle spacing. These characteristics afford the desired combination of high strength and ductility in the heat treated material. Consolidated articles produced from the alloys of the invention can have intermetallic precipitate particles ranging from about 10 nm to about 100 nm in maximum diameter, and have an average interparticle spacing ranging from about 50 nm to 500 nm.

Alloys of the invention are able to tolerate the heat and pressure of conventional powder metallurgy techniques without developing very coarse intermetallic phases that would reduce the strength and ductility of the consolidated article to unacceptably low levels. In addition, alloys of the invention are able to withstand unconventionally high processing temperatures, and withstand long exposure times at high temperature during processing. For example, alloys can be forged at 430° C. and exposed to such temperatures for time periods of up to six hours without detrimentally coarsening the microstructure. After such forging, the alloy can provide a tensile strength of approximately 450 MPa (65 Ksi) with tensile strain to fracture of up to 10% elongation.

As a result, alloys of the invention are particularly useful for forming high strength consolidated aluminum alloy articles. The alloys are particularly advantageous because they can be compacted over a broad range of pressing temperatures and still provide the desired combination of strength and ductility in the compacted article. For example, one of the preferred alloys, Al-12Fe-2V can be compacted into a consolidated article having a hardness of at least 92 $R_B$ even when extruded at temperatures up to approximately 490° C.

Rapidly solidified alloys having the $Al_{bal}Fe_aV_bX_c$ composition described above can be processed into particles by conventional comminution devices such as pulverizers, knife mills, rotating hammer mills and the like. Preferably, the comminuted powder particles have a size ranging from about -60 to 200 mesh, U.S. Standard sieve size.

The particles are placed in a vacuum of less than $10^{-4}$ torr ($1.33\times10^{-2}$ Pa) preferably less than $10^{-5}$ torr ($1.33\times10^{-3}$ Pa), and then compacted by conventional powder metallurgy techniques. In addition, the particles are heated at a temperature ranging from about 300° C.-500° C., preferably ranging from about 325° C.-400° C., minimize the growth or coarsening of the intermetallic phases therein. The heating of the powder particles preferably occurs during the compacting step. Suitable powder metallurgy techniques include direct powder rolling, vacuum hot compaction, blind die compaction in an extrusion press or forging press, direct and indirect extrusion, conventional and impact forging, impact extrusion and combinations of the above.

Figure 9:
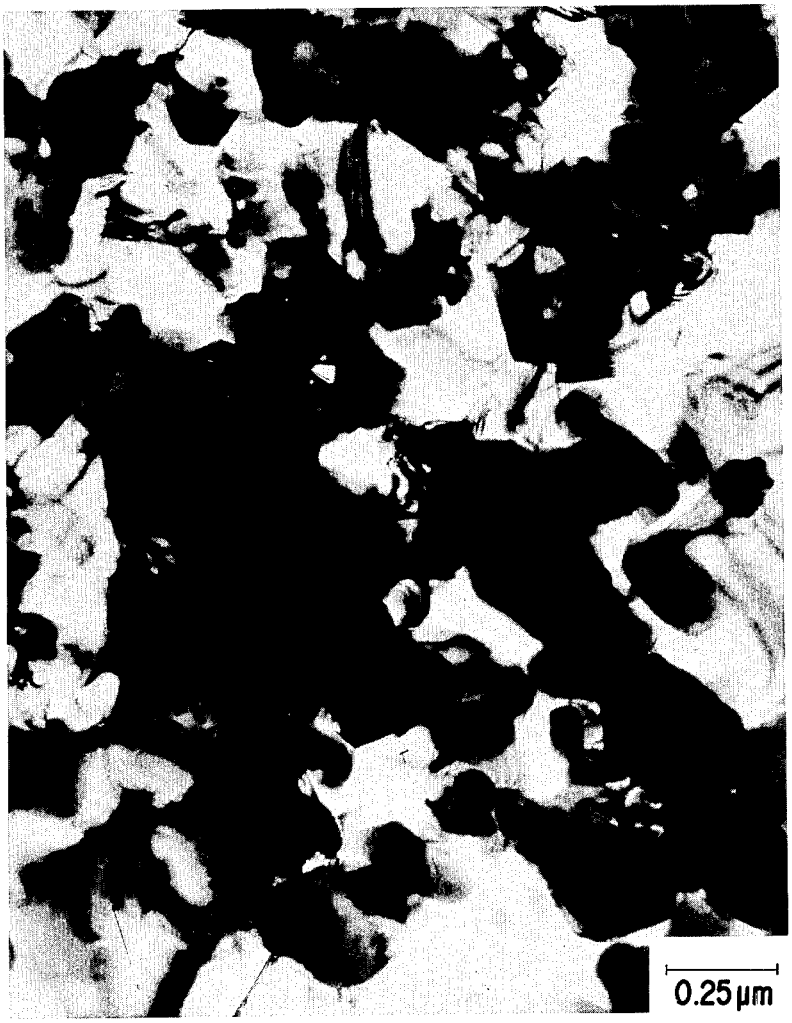
FIG. 9 shows an electron micrograph of the microstructure of a consolidated article of the invention.

As representatively shown in FIG. 9, the compacted consolidated article of the invention is composed of an aluminum solid solution phase containing a substantially uniform distribution of dispersed, intermetallic phase precipitates therein. The precipitates are fine, irregularly shaped intermetallics measuring less than about 100 nm in all linear dimensions thereof; the volume fraction of these fine intermetallics ranges from about 25 to 45%, and preferably, ranges from about 30–40% to provide improved properties. Each of the fine intermetallics has a largest linear dimension measuring not more than about 20 nm, and the volume fraction of coarse intermetallic precipitates (i.e. precipitates measuring more than about 100 nm in the largest dimension thereof) is not more than about 1%.

At room temperature (about 20° C.), the compacted, consolidated article of the invention has a Rockwell B hardness ($R_B$) of at least about 80. Additionally, the ultimate tensile strength of the consolidated article is at least about 550 MPa (80 ksi), and the ductility of the article is sufficient to provide an ultimate tensile strain of at least about 3% elongation. At approximately 350° C., the consolidated article has an ultimate tensile strength of at least about 240 MPa (35 ksi) and has a ductility of at least about 10% elongation.

Preferred consolidated articles of the invention have an ultimate tensile strength ranging from about 550 to 620 MPa (80 to 90 ksi) and a ductility ranging from about 4 to 10% elongation, when measured at room temperature. At a temperature of approximately 350° C., these preferred articles have an ultimate tensile strength ranging from about 240 to 310 MPa (35 to 45 ksi) and a ductility ranging from about 10 to 15% elongation. In addition the elastic and shear moduli of the consolidated alloys are significantly improved over conventional aluminum alloy consolidated articles. For example, the Young's modulus is about 98 GPa ($14.2\times10^6$ psi) for consolidated Al-12Fe-2V and is about 110 GPa ($16.0\times10^6$ psi) for Al-14Fe-4V. These values are at least about 40% higher than the Young's moduli for conventional alloys, such as 7075 and 2019.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES 1–8

The alloys of the invention listed in TABLE 1 were cast, and the microstructures of the alloys were at least 50% composed of a substantially spherical, intermetallic O-phase.

TABLE 1

1. Al-10Fe-2V
2. Al-12Fe-2V
3. Al-8Fe-3V
4. Al-9Fe-2.5V
5. Al-10Fe-3V
6. Al-11Fe-2.5V
7. Al-12Fe-3V
8. Al-11.75Fe-2.5V

EXAMPLE 9

Approximately 10 kg of Al-12Fe-2V powder was placed in a vacuum evacuated can, measuring 24 in×20 in×3 in, and forged at 800° F. (430° C.) into 1.5 in thick plates over a period of 6 hours. The properties of the forged alloy are shown in Table 3.

TABLE 3

| Forging Strain | Ultimate Tensile Strength | % Elongation |
|---|---|---|
| 100% | 620 MPa (90 Ksi) | 1% |
| 160% | 450 MPa (65 Ksi) | 10% |

Having thus described the invention in rather full detail, it will be understood that these details need not be strictly adhered to but that various changes and modifications may suggest themselves to one skilled in the art, all falling within the scope of the invention as defined by the subjoined claims.

What is claimed:

1. An aluminum-base alloy consisting essentially of the formula $Al_{bal}Fe_aV_bX_c$, wherein X is at least one element selected from the group consisting of Zn, Co, Ni, Cr, Mo, Zr, Ti, Hf, Y and Ce, "a" ranges from about 7–15 wt %, "b" ranges from about 2–10 wt % "c" ranges from about 0–5 wt % and the balance is aluminum, said alloy having been uniformly quenched at a cooling rate of at least about $10^7$° C./sec by being forced under pressure through a slotted nozzle and into contact with a casting surface in close proximity thereto and moving at a speed of at least about 4000 ft/min, and having a microstructure which is at least about 50% composed of a generally spherical, intermetallic O-phase.

2. An alloy as recited in claim 1, wherein said alloy has an as-cast hardness of at least about 350 kg/mm$^2$ at room temperature.

3. An alloy as recited in claim 1, wherein said O-phase has a diameter of at least about 50 nm.

4. An aluminum-base alloy consisting essentially of the formula $Al_{bal}Fe_aV_b$ wherein "a" ranges from about 7–15 wt %, "b" ranges from about 2–10 wt % and the balance is aluminum, said alloy having been uniformly quenched at a cooling rate of at least about $10^7$° C./sec by being forced under pressure through a slotted nozzle and into contact with a casting surface in close proximity thereto and moving at a speed of at least about 4000 ft/min, and having a microstructure at least about 50% of which is composed of a generally spherical, intermetallic O-phase.

5. An aluminum-base alloy as recited in claim 4, wherein "a" ranges from about 12–15 wt %, "b" ranges from about 2–4 wt % and the balance is aluminum.

6. An alloy as recited in claim 4, wherein said O-phase has a diameter of at least about 50 nm.

7. An aluminum-base alloy as recited in claim 5, wherein up to about 2 wt % of the Al is optionally replaced by one or more of the elements selected from the group consisting of Zn, Co, Ni, Cr, Mo, Zr, Ti, Y, Hf and Ce.

8. An alloy as recited in claim 5, wherein said O-phase has a diameter of at least about 50 nm.

9. A method for forming a consolidated metal alloy article, comprising the steps of:

compacting particles composed of an aluminum-base alloy consisting essentially of the formula $Al_{bal}Fe_aV_bX_c$, wherein X is at least one element selected from the group consisting of Zn, Co, Ni, Cr, Mo, Zr, Hf, Ti, Y and Ce, "a" ranges from about 7–15 wt % "b" ranges from about 2–10 wt %, "c" ranges from about 0–5 wt % and the balance is Al, said alloy having been uniformly quenched at a cooling rate of at least about $10^7$° C./sec by being forced under pressure through a slotted nozzle and into contact with a casting surface in close proximity thereto and moving at a speed of at least about 4000 ft/min, and having a microstructure which is at least about 50% composed of a generally spherical intermetallic O-phase; and heating said particles in a vacuum during said compacting step to a temperature ranging from about 300° to 500° C.

10. A method as recited in claim 9, which said heating step comprises heating said particles to a temperature ranging from about 325° to 400° C.

11. A consolidated metal article compacted from particles of an aluminum-base alloy consisting essentially of the formula $Al_{bal}Fe_aV_bX_c$, wherein X is at least one element selected from the group consisting of Zn, Co, Ni, Cr, Mo, Zr, Ti, Hf, Y and Ce, "a" ranges from about 7 to 15 wt %, "b" ranges from about 2 to 10 wt %, "c" ranges from about 0–5 wt % and the balance is Al, said alloy having been uniformly quenched at a cooling rate of at least about $10^7$° C./sec by being forced under pressure through a slotted nozzle and into contact with a casting surface in close proxity thereto and moving at a speed of at least about 4000 ft/min, and having at least about 50% O-phase microstructure;

said consolidated articles being composed of an aluminum solid solution phase containing therein a substantially uniform distribution of dispersed, intermetallic phase precipitates, wherein said precipitates are fine intermetallics measuring from about 10 nm to about 100 nm in diameter with an average interparticle spacing ranging from about 50 nm to about 500 nm.

* * * * *